US010371158B2

(12) United States Patent
Sorokes

(10) Patent No.: US 10,371,158 B2
(45) Date of Patent: Aug. 6, 2019

(54) SYSTEM AND METHOD FOR DETECTING STALL OR SURGE IN RADIAL COMPRESSORS

(71) Applicant: Dresser-Rand Company, Olean, NY (US)

(72) Inventor: James M. Sorokes, Olean, NY (US)

(73) Assignee: DRESSER-RAND COMPANY, Olean, NY (US)

( * ) Notice: Subject to any disclaimer, the term of this patent is extended or adjusted under 35 U.S.C. 154(b) by 249 days.

(21) Appl. No.: 14/417,673

(22) PCT Filed: Aug. 15, 2013

(86) PCT No.: PCT/US2013/055099

§ 371 (c)(1),
(2) Date: Jan. 27, 2015

(87) PCT Pub. No.: WO2014/028711

PCT Pub. Date: Feb. 20, 2014

(65) Prior Publication Data

US 2016/0032932 A1 Feb. 4, 2016

Related U.S. Application Data

(60) Provisional application No. 61/684,393, filed on Aug. 17, 2012.

(51) Int. Cl.

| | |
|---|---|
| ***F04D 17/10*** | (2006.01) |
| ***F04D 27/00*** | (2006.01) |
| ***F04D 27/02*** | (2006.01) |
| ***F04D 29/44*** | (2006.01) |

(52) U.S. Cl.

CPC ..... *F04D 27/001* (2013.01); *F04D 17/10* (2013.01); *F04D 27/0215* (2013.01); *F04D 29/441* (2013.01)

(58) Field of Classification Search

CPC .. F04D 27/02; F04D 27/0207; F04D 27/0215; F04D 27/0223; F04D 27/023;

(Continued)

(56) References Cited

U.S. PATENT DOCUMENTS 3,886,790 A * 6/1975 Plett ..... G01L 5/133 73/112.04
3,901,620 A * 8/1975 Boyce ..... F04D 27/02 415/1

(Continued)

FOREIGN PATENT DOCUMENTS

| | | |
|---|---|---|
| JP | 06-167299 A | 6/1994 |
| JP | 2011-117345 A | 6/2011 |
| KR | 10-0362448 B1 | 3/2003 |

OTHER PUBLICATIONS

Giorgio Pavesi, Antoine Dazin, Giovanna Cavazzini, Guy Caignaert, Gerard Bois and Guido Ardizzon, "Experimental and Numerical Investigation of Unforced Unsteadiness in a Vaneless Radial Diffuser", 9th European Conference on Turbomachinery-fluid Dynamics and Thermodynamics, Turkey, Mar. 21, 2011, pp. 1-12.

(Continued)

*Primary Examiner* — Richard A Edgar

(57) ABSTRACT

A system and method are provided for detecting an impending stall or surge in a radial compressor. The system and method may include a plurality of detection devices configured to detect a transition of a low momentum zone of a gas flow through the diffuser from a first position adjacent a shroud wall of the diffuser to a second position adjacent a hub wall of the diffuser. The system and method may also include a control system electrically coupled to the plurality of detection devices and configured to receive a plurality of information signals. Each information signal may be transmitted by a respective one of the plurality of detection devices and may correlate to a location of the low momen- (Continued)

tum zone. The control system may be configured to process the plurality of information signals and detect the impending stall or surge based on the location of the low momentum zone.

5 Claims, 4 Drawing Sheets

(58) Field of Classification Search
CPC ..... F04D 27/0238; F04D 27/0246; F04D 27/0253; F04D 27/0261; F04D 27/0269; F04D 27/0276; F04D 27/001
See application file for complete search history.

(56) References Cited

U.S. PATENT DOCUMENTS 5,095,714 A * 3/1992 Adachi ..... F25B 49/022 415/48
5,195,875 A 3/1993 Gaston
5,275,528 A 1/1994 Freeman et al.
6,036,432 A 3/2000 Sishtla et al.
6,213,724 B1 4/2001 Haugen et al.
6,857,845 B2 2/2005 Stabley et al.
7,596,953 B2 10/2009 Krok et al.
2008/0253877 A1 10/2008 Bodell et al.

OTHER PUBLICATIONS

James M. Sorokes, Clementine Vezier, Jorge E. Pacheco, Syed Fakhri and Dresser-Rand Company, "An Analytical and Experimental Assessment of a Diffuser Flow Phenomenon as a Precursor to Stall", Proceedings of ASME Turbo Expo, XX, Copenhagen, Denmark, vol. 8, No. GT2012-69122, Jun. 11, 2012, pp. 757-766.

* cited by examiner

SYSTEM AND METHOD FOR DETECTING STALL OR SURGE IN RADIAL COMPRESSORS

The present application claims priority to U.S. Provisional Patent Application Ser. No. 61/684,393, which was filed Aug. 17, 2012. This priority application is hereby incorporated by reference in its entirety into the present application, to the extent that it is not inconsistent with the present application.

BACKGROUND

Original equipment manufacturers (OEMs) providing centrifugal compressors for the process market industry, e.g., oil and gas, petrochemical, gas transmission applications, and the like, have seen an increasing demand for stages of the centrifugal compressors operating at higher flow coefficients and higher machine or inlet relative Mach numbers. Such demands are typically driven by a desire to reduce the footprint of the compressor or to compress larger amounts of gas within a smaller casing. As a direct result, many process centrifugal compressors now operate at machine Mach numbers, U2/A0s, in excess of 1.2 and shroud relative Mach numbers of 0.95 and higher.

In designing such smaller or higher capacity centrifugal compressors, focus is generally directed to the impeller design, and in addition, the design of the stationary components, such as the diffuser. In operation, common issues resulting from improper diffuser design are instabilities known as surge and rotating stall. Typically, rotating stall occurs because the design of the diffuser, in many cases a vaneless diffuser, is unable to accommodate all flow without some of the flow experiencing separation in the diffuser passageway. Rotating stall results in the creation of low frequency pulsations at fundamental frequencies generally less than the rotating frequency of the impeller. Such lower frequency pulsations or vibrations may propagate downstream through the gas passageways and potentially result in performance degradation in the centrifugal compressor, the control system of the centrifugal compressor, and/or associated components. Rotating stall is also recognized as a precursor to surge. Surge is a far more violent event that can cause premature failure of compressor components.

Surge/stall detection and avoidance systems have been proposed to reduce or eliminate the occurrence of rotating stall and/or surge in centrifugal compressors. In particular, some of the aforementioned systems rely on external instrumentation to measure inlet and outlet gas flow properties; however, such external instrumentation may be subjected to undesirable external conditions. Other systems rely on the measurement of acoustic energy in the gas stream to detect a surge or rotating stall. However, such systems may be subject to the vibrations provided by the rotating stall, thereby reducing the longevity of the system.

What is needed, then, is an efficient and reliable system and method of detecting an impending rotating stall and/or surge before the actual occurrence of the rotating stall and/or surge.

SUMMARY

Embodiments of the disclosure may provide a detection system for detecting an impending stall or surge in a radial compressor. The detection system may include a plurality of detection devices coupled to the radial compressor. At least a portion of each detection device may be disposed in a diffuser channel of a diffuser of the radial compressor. The plurality of detection devices may be configured to detect a transition of a low momentum zone of a gas flow through the diffuser from a first position adjacent a shroud wall of the diffuser to a second position adjacent a hub wall of the diffuser. The detection system may also include a control system electrically coupled to the plurality of detection devices and configured to receive a plurality of information signals. Each information signal may be transmitted by a respective one of the plurality of detection devices and may correlate to a location of the low momentum zone. The control system further may be configured to process the plurality of information signals and detect the impending stall or surge based on the location of the low momentum zone.

Embodiments of the disclosure may further provide a method for detecting an impending stall or surge in a radial compressor. The method may include at least partially disposing a plurality of detection devices in a diffuser channel of a diffuser of the radial compressor, and transmitting an information signal from each of the plurality of detection devices to a control system. The information signal may correlate to a location of a low momentum zone of a gas flow in the diffuser channel. The method may also include processing in the control system the information signal received from each of the plurality of detection devices, such that the control system detects the location of the low momentum zone at a second position proximate a hub wall of the diffuser. The method may further include detecting in the control system the impending stall or surge from the location of the low momentum zone being at the second position proximate the hub wall of the diffuser.

Embodiments of the disclosure may further provide a method for avoiding an impending stall or surge in a radial compressor. The method may include at least partially disposing a plurality of detection devices in a diffuser channel of a diffuser of the radial compressor, and transmitting an information signal from each of the plurality of detection devices to a control system. The information signal may correlate to a location of a low momentum zone of a gas flow in the diffuser channel. The method may also include processing in the control system the information signal received from each of the plurality of detection devices, such that the control system detects the location of the low momentum zone at a second position proximate a hub wall of the diffuser. The method may further include detecting in the control system the impending stall or surge from the location of the low momentum zone being at the second position proximate the hub wall of the diffuser. The method may also include transmitting from the control system a command signal generated by the control system and based on the location of the low momentum zone, and varying a flow rate of the gas flow in the radial compressor based on the command signal received by the control system.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
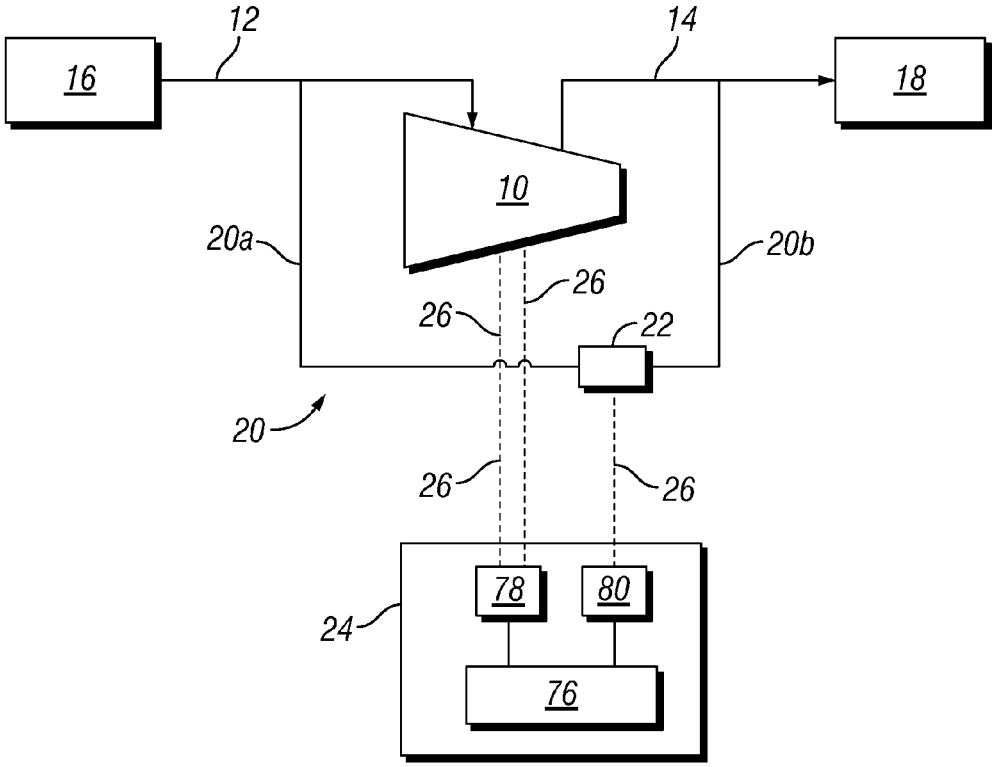
FIG. 1 illustrates a schematic view of a system for detecting and avoiding an impending stall or surge in a radial compressor, according to an embodiment.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

FIG. 1 illustrates an exemplary system for detecting an impending stall or surge in a radial compressor, and in particular, a centrifugal compressor 10. In addition, as shown in FIG. 1, the system may further be configured to avoid the impending stall or surge. The system may include a centrifugal compressor 10 in fluid communication with an inlet line 12 and an outlet line 14. The inlet line 12 may be configured to supply a working fluid from an external gas source 16 at a first pressure to the centrifugal compressor 10. The outlet line 14 may be configured to transport the working fluid, at a second pressure, greater than the first pressure, to downstream processing components 18. The system may further include a bypass line 20 connecting the inlet line 12 and outlet line 14. The bypass line 20 may further be formed from a first bypass line 20*a* and a second bypass line 20*b* coupled together via a bypass valve 22. The system may also include a control system 24 electrically coupled to the centrifugal compressor 10 and the bypass valve 22 via transmission wires 26, or wirelessly, the control system 24 being discussed in further detail below.

Figure 2:
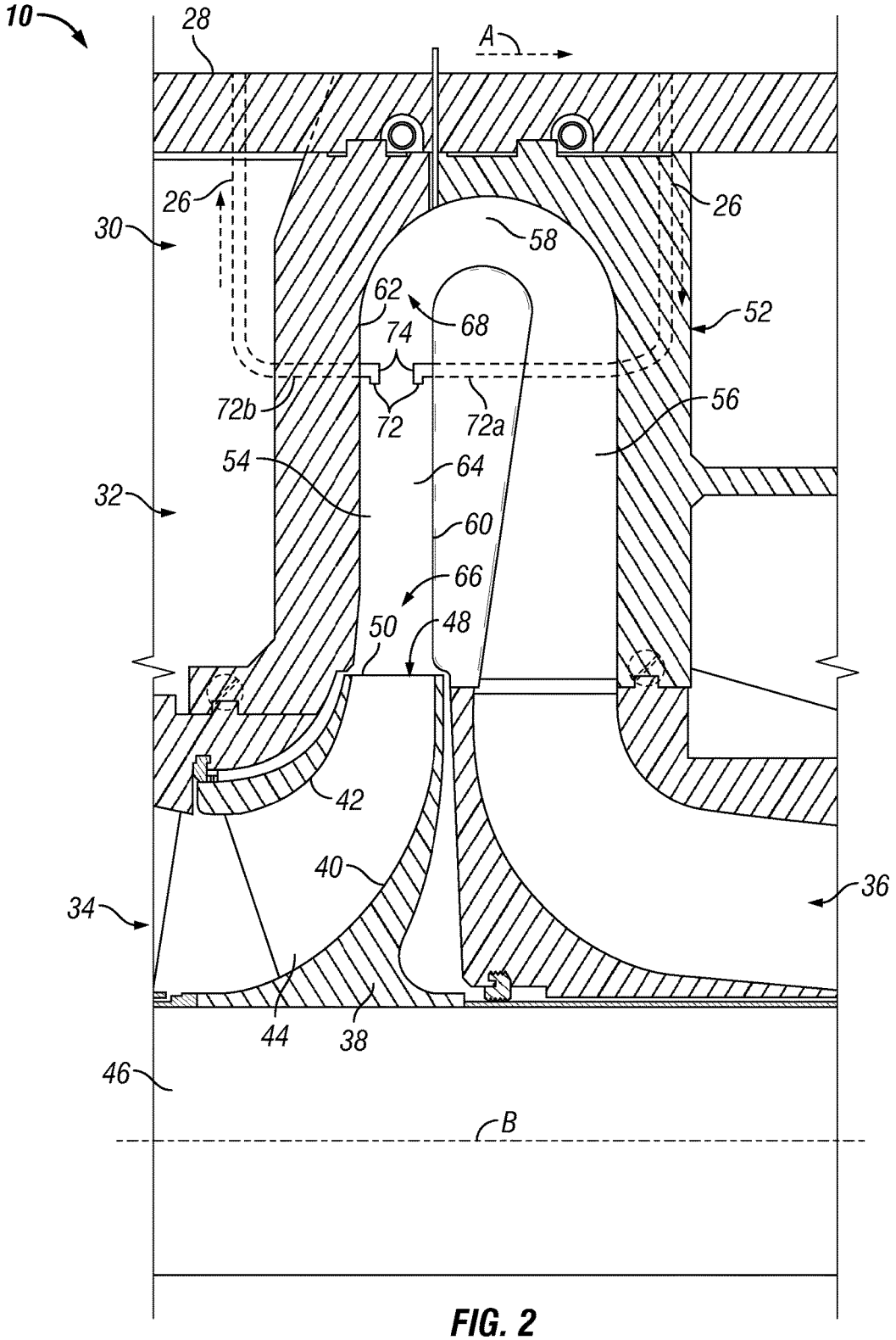
FIG. 2 illustrates a cross-sectional view of a section of the radial compressor of FIG. 1.
Figure 3B:
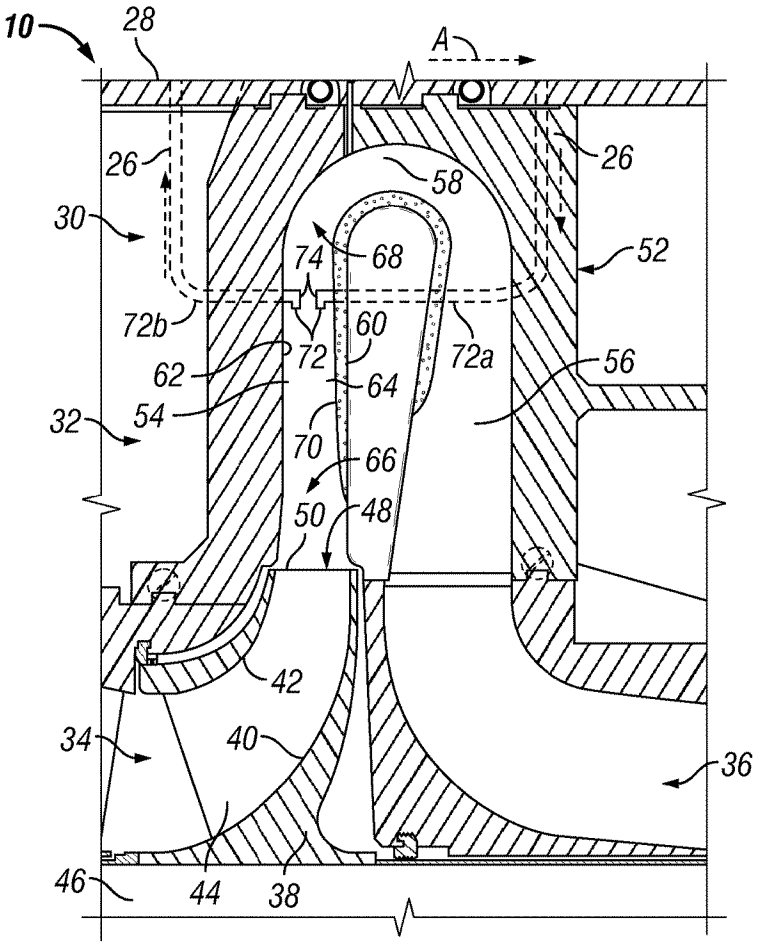
FIG. 3B illustrates a cross-sectional view of the section of the radial compressor of FIG. 2, including a low-momentum zone of gas flow in the diffuser channel and adjacent the hub wall of the diffuser.
Figure 3A:
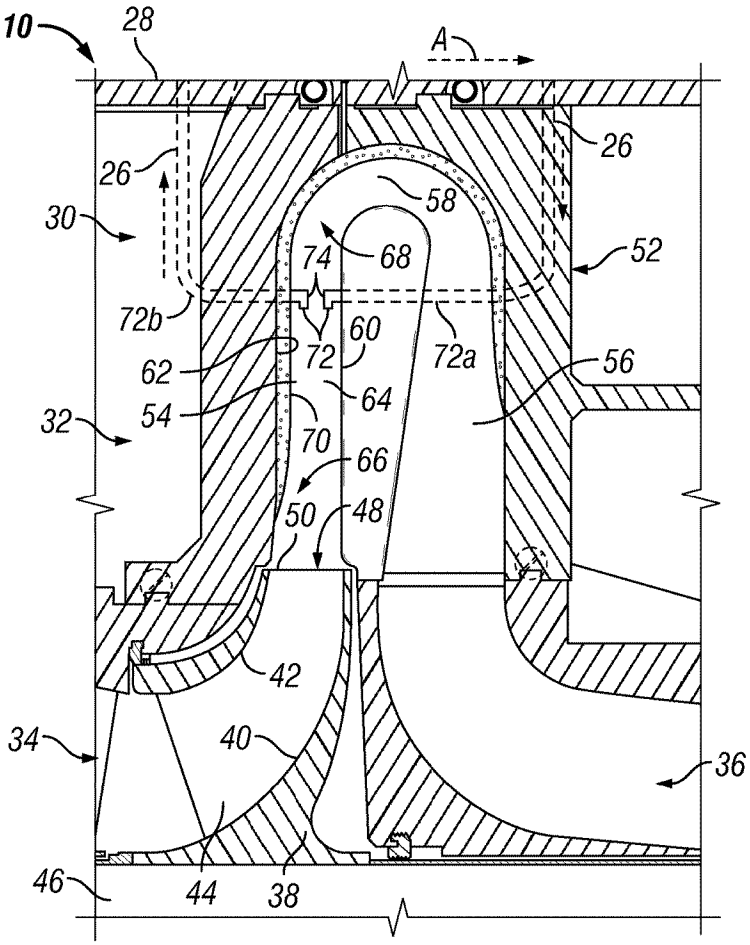
FIG. 3A illustrates a cross-sectional view of the section of the radial compressor of FIG. 2, including a low-momentum zone of gas flow in the diffuser channel and adjacent the shroud wall of the diffuser.

FIGS. 2, 3A, and 3B illustrate an exemplary section of the centrifugal compressor 10 including a casing 28 enclosing an internal compression assembly 30 having a plurality of stages 32. For simplicity, a single stage 32 of the internal compression assembly 30 is illustrated in FIGS. 2, 3A, and 3B, and will be discussed as follows; however, it will be appreciated by one of ordinary skill in the art that the centrifugal compressor 10 may be a single-stage or multi-stage compressor having a plurality of stages 32, in which substantially similar compression stages are in fluid communication such that each stage 32 may provide a higher-pressure gas to a subsequent downstream stage.

It will be appreciated by those of ordinary skill in the art that the centrifugal compressor 10 may be used for the compression of the working fluid discussed above, such as methane, natural gas, air, oxygen, nitrogen, hydrogen, R-134A refrigerant, or any other desired gas. In addition, the centrifugal compressor 10 may be utilized in a multitude of applications, including but not limited to, the compression of $CO_2$ associated with carbon capture and sequestration projects and other similar attempts to reduce emissions while conserving energy.

In an exemplary embodiment, the gas may flow through the centrifugal compressor 10 generally in the direction of arrow A from a stage inlet 34 to a stage outlet 36. The stage inlet 34 may be coupled to the inlet line 12 configured to flow the gas therethrough from the external gas source 16, such that the external gas source 16 may be in fluid communication with the centrifugal compressor 10 having the compressor casing 28 and associated compressor components therein. The stage outlet 36 may be coupled to one or more downstream processing components 18 via outlet line 14 such that the centrifugal compressor 10 and the downstream processing components 18 may be in fluid communication, such that gas flowing through the centrifugal compressor 10 may be routed to the downstream processing components 18 for further processing of the pressurized gas.

The centrifugal compressor 10 may include an impeller 38 configured to rotate within the internal compression assembly 30 enclosed in the compressor casing 28. In an exemplary embodiment, the impeller 38 includes a generally cylindrical hub 40, a generally conical shroud 42 spaced axially from the hub 40 and a plurality of blades 44 extending between the hub 40 and shroud 42 and spaced circumferentially apart from each other. The impeller 38 may be operatively coupled to a rotary shaft 46 such that the rotary shaft 46 when acted upon by a rotational power source (not shown) rotates about a central axis B, thereby causing the impeller 38 to rotate such that gas flowing into the stage inlet 34 is drawn into the impeller 38 and urged to a plurality of outlets 48 defined between the outer radial blade ends 50 of the impeller 38. The gas flow is directed radially outwardly from the shaft central axis B, thereby increasing the velocity of the gas.

The centrifugal compressor 10 may include a high flow coefficient, high inlet relative Mach number impeller. In an exemplary embodiment, the centrifugal compressor 10 may operate at machine Mach numbers, U2/A0s, in excess of 1.2 and shroud relative Mach numbers of 0.95 and higher. An exemplary centrifugal compressor may be a DATUM® centrifugal compressor manufactured by Dresser-Rand of Houston, Tex.

The centrifugal compressor 10 may include a diaphragm 52 disposed about the impeller 38 and configured to direct fluid between adjacent stages (not shown). In an exemplary embodiment, the diaphragm 52 may include a diffuser 54 proximate to the plurality of outlets 48 of the impeller 38 and in fluid communication therewith. The diffuser 54 is configured to convert the velocity of the gas received from the impeller 38 to pressure energy, thereby resulting in the compression of the gas. The diaphragm 52 further includes a return channel 56 in fluid communication with the diffuser 54 via a return bend 58 and configured to receive the compressed gas from the diffuser 54 and eject the compressed gas from the gas flow path via the stage outlet 36, or otherwise injects the compressed gas into a succeeding compressor stage (not shown). In an exemplary embodiment, the diffuser 54 is a vaneless diffuser, such that the no diffuser vanes are present in the diffuser 54; however, embodiments in which the diffuser 54 includes a plurality of diffuser vanes (not shown) are contemplated herein. The diaphragm 52 may further include a plurality of return channel vanes (not shown) arranged within the return channel 56.

As shown in FIGS. 2, 3A, and 3B, the exemplary diffuser 54 may be formed from two parallel walls 60,62 of the diaphragm 52. The two parallel walls 60,62 may be referred to as a hub wall 60 and a shroud wall 62. The hub wall 60 may be located adjacent the cylindrical hub 40 of the impeller 38, whereas the shroud wall 62 may be located adjacent the conical shroud 42 of the impeller 38. The two walls 60,62 define a diffuser channel 64 or flow path for the gas flow therethrough. The diffuser 54 further includes a diffuser inlet 66 located proximal the plurality of outlets 48 of the impeller 38 and a diffuser outlet 68 located proximal the return bend 58. The distance from the central axis B of the rotary shaft 46 to the diffuser outlet 68 may be referred to as the diffuser radius.

In centrifugal compressors including high flow coefficient, high inlet relative Mach number impellers, a phenomena has been discovered regarding both vaneless and vaned diffusers downstream of the high flow coefficient, high inlet relative Mach number impeller. It has been found that a unique pressure field anomaly exists in the gas flow through the diffuser channel immediately prior to a rotating stall occurring in the stage. As shown in FIGS. 3A and 3B, It has been observed that, immediately prior to rotating stall, the low momentum zone 70 or "dead zone" typically formed along the shroud wall 62 of the diffuser 54 (as shown in FIG. 3A) suddenly shifts from the shroud wall 62 of the diffuser 54 to the hub wall 60 of the diffuser 54 (as shown in FIG. 3B). Slightly reducing the flow rate resulted in the centrifugal compressor 10 exhibiting characteristics consistent with rotating stall. Thus, the swapping of the low momentum zone 70 from the shroud wall 62 of the diffuser 54 to the hub wall 60 of the diffuser 54 preceded the event. From the foregoing, it has been determined that the detection of the swapping phenomenon of the low momentum zone 70 may provide for the avoidance of operating in stall or surge in centrifugal compressors.

Accordingly, one or more detection devices 72 may be disposed in the centrifugal compressor 10 to detect the movement of the low momentum zone 70 from the shroud wall 62 to the hub wall 60 of the diffuser 54. In an exemplary embodiment, the detection devices 72 may be configured to detect the pressure of the gas flow at predetermined locations in the diffuser 54 to determine the movement of the low momentum zone 70 of the gas flow. In an exemplary embodiment, the centrifugal compressor 10 includes a first detection device 72*a* configured to measure the pressure of the gas flow at the hub wall 60 of the diffuser 54 and a second detection device 72*b* configured to measure the pressure of the gas flow at the shroud wall 62 of the diffuser 54. The detection device 72 may include one or more sensors 74. The sensors 74 may be static pressure taps, total pressure probes, combination probes, dynamic pressure probes, 5-hole probes, 3-hole probes, and the like. Regarding the combination probes, such probes may include a half-shielded thermocouple and a Kiel-head pressure probe to measure total temperature and total pressure.

It will be understood by one of ordinary skill in the art that the number and location of detection devices 72 at least partially disposed in the diffuser 54 may vary. For example, in an exemplary embodiment of FIG. 2, detection device 72*b*, illustrated as a probe 74, is at least partially disposed adjacent the shroud wall 62 of the diffuser 54, and another detection device 72*a*, also illustrated as a probe 74, is partially disposed adjacent the hub wall 60 of the diffuser 54. The diffuser 54 may have a plurality of detection devices 72 disposed adjacent either the shroud wall 62 or the hub wall 60, such that the detection devices 72 may extend into the diffuser channel 64 at varied lengths to measure the pressure at corresponding locations. For example, the diffuser 54 may have two probes 74 extending from the hub wall 60 of the diffuser 54, such that one of the probes 74 extends into the diffuser channel 64 approximately one-third the diameter of the diffuser channel 64, whereas the other probe 74 may extend approximately two-thirds the diameter of the diffuser channel 64. Accordingly, the probe 74 extending one-third the diameter of the diffuser channel 64 may measure the pressure at the hub wall 60 of the diffuser 54, and the other probe 74 extending two-thirds of the diameter of the diffuser channel 64 may measure the pressure of the gas flow at the shroud wall 62. In addition, the detection devices 72 may be disposed at varying locations along the diffuser walls 60,62, such that a detection device 72 may be disposed proximal the diffuser inlet 66, the diffuser outlet 68, and/or at any location between the two.

The control system 24 may form a portion of a feedback loop created from the connection of the centrifugal compressor 10, the bypass valve 22, and the control system 24. The detection devices 72 may be further coupled to the control system 24, such that information related to the low momentum zone 70 of the gas flow through the diffuser channel 64 may be received and processed. The control system 24 may be further configured to transmit an instruction signal based on the information received and processed from the detection devices 72. In an exemplary embodiment, the control system 24 may be coupled to the bypass valve 22, as discussed above, such that the instruction signal may provide for the opening or closing of the bypass valve 22 via a command signal, discussed below, to control the flow rate of the gas flow into the centrifugal compressor 10 from the outlet line 14, thereby controlling the development and movement of the low momentum zone 70 of the gas flow in the diffuser 54.

In an exemplary operation, the gas flow is provided to the centrifugal compressor 10 from the external gas source 16. The rotary shaft 46 of the centrifugal compressor 10 is driven by an external driver (not shown), thereby urging the gas flow into the diffuser 54. The detection devices 72 at least partially disposed in the diffuser 54 include at least one probe 74 measuring the pressure proximal the shroud wall 62 of the diffuser 54 and at least one other probe 74 measuring the pressure proximal the hub wall 60 of the diffuser 54. The probes 74 transmit respective information signals to the control system 24 corresponding to the respective pressure measurements. The control system 24 receives and processes such information signals to determine the location of the low momentum zone 70 in the diffuser 54. During the period of gas flow in which the control system 24 determines the low momentum zone 70 is proximal the shroud wall 62 of the diffuser 54, the control system 24 remains idle with respect to the transmission of command signals to the bypass valve 22; however, if the control system 24 processes the respective probe information signals and determines that the low momentum zone 70 is shifting to the hub wall 60 of the diffuser 54, a command signal may be sent to the bypass valve 22, such that the bypass valve 22 may be adjusted to provide for a higher flow rate of gas into the centrifugal compressor 10 in order to avoid the occurrence of rotating stall.

The control system 24 may include a controller 76, the controller being a proportional-integral-derivative (PID) controller, a proportional-integral (PI) controller, or the like. The control system 24 may further include an analog to digital (A/D) converter 78 and/or a digital to analog (D/A) converter 80. In instances in which the controller 76 may process digital signals and the probes 74 transmit analog signals, the A/D converter 78 may be employed to convert the analog signals generated by the probes 74 to digital signals to be processed by the controller 76. Further, digital instruction signals provided by the controller 76 may be converted to analog signals via the D/A converter 80 in instances in which the bypass valve 22 is configured to receive and process analog signals.

Figure 4:
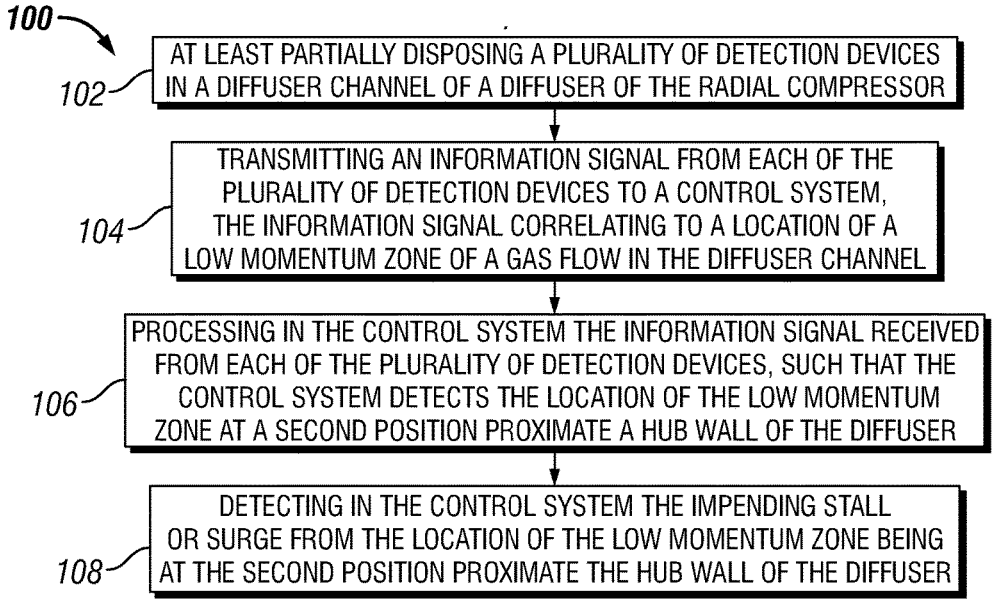
FIG. 4 is a flowchart of a method for detecting an impending stall or surge in a radial compressor, according to an embodiment.

FIG. 4 is a flowchart of a method 100 for detecting an impending stall or surge in a radial compressor. In an exemplary embodiment, the method 100 may include at least partially disposing a plurality of detection devices in a diffuser channel of a diffuser of the radial compressor, as at 102. The method 100 may also include transmitting an information signal from each of the plurality of detection devices to a control system, the information signal correlating to a location of a low momentum zone of a gas flow in the diffuser channel, as at 104

The method 100 may further include processing in the control system the information signal received from each of the plurality of detection devices, such that the control system detects the location of the low momentum zone at a second position proximate a hub wall of the diffuser, as at 106. The method 100 may also include detecting in the control system the impending stall or surge from the location of the low momentum zone being at the second position proximate the hub wall of the diffuser, as at 108.

Figure 5:
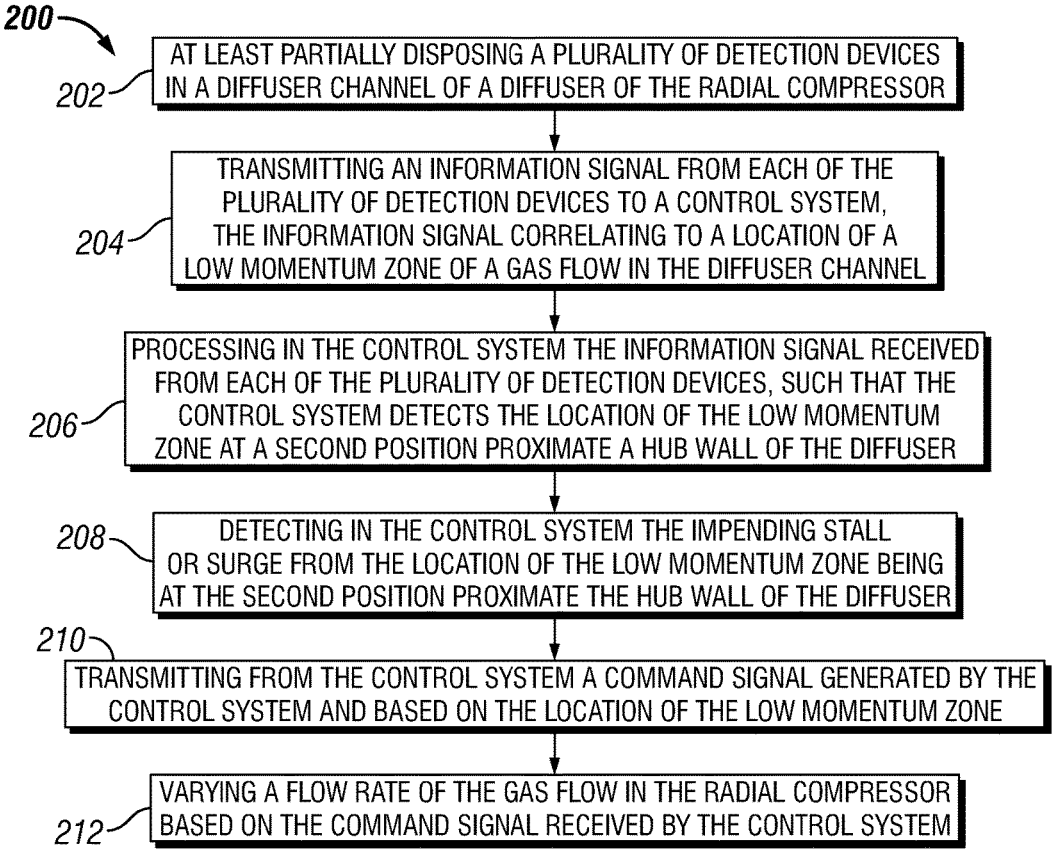
FIG. 5 is a flowchart of a method for avoiding an impending stall or surge in a radial compressor, according to an embodiment.

FIG. 5 is a flowchart of a method 200 for avoiding an impending stall or surge in a radial compressor. In an exemplary embodiment, the method 200 may include at least partially disposing a plurality of detection devices in a diffuser channel of a diffuser of the radial compressor, as at 202. The method 200 may also include transmitting an information signal from each of the plurality of detection devices to a control system, the information signal correlating to a location of a low momentum zone of a gas flow in the diffuser channel, as at 204.

The method 200 may further include processing in the control system the information signal received from each of the plurality of detection devices, such that the control system detects the location of the low momentum zone at a second position proximate a hub wall of the diffuser, as at 206. The method 200 may also include detecting in the control system the impending stall or surge from the location of the low momentum zone being at the second position proximate the hub wall of the diffuser, as at 208. The method 200 may further include transmitting from the control system a command signal generated by the control system and based on the location of the low momentum zone, as at 210, and varying a flow rate of the gas flow in the radial compressor based on the command signal received by the control system, as at 212.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

I claim:

1. A detection system for detecting an impending stall or surge in a radial compressor, comprising:

a plurality of detection devices coupled to the radial compressor, at least a portion of each detection device disposed in a diffuser channel of a diffuser of the radial compressor, the plurality of detection devices arranged to measure pressure of gas flow at different locations in the diffuser channel to detect a transition of a low momentum zone of a gas flow through the diffuser from a first location of the different locations in the diffuser channel adjacent a shroud wall of the diffuser to a second location of the different locations in the diffuser channel adjacent a hub wall of the diffuser;

a control system communicatively coupled to the plurality of detection devices and configured to receive information from the plurality of detection devices and correlating to a location of the low momentum zone, the control system further being configured to process the information and detect the impending stall or surge based on the transition of the low momentum zone from the first location to the second location;

a bypass valve electrically coupled to the control system and in direct fluid communication with the radial compressor, wherein the control system is further configured to generate and transmit a command signal to the bypass valve based on the transition of the low momentum zone, and the bypass valve is configured to receive the command signal and vary the amount of the gas flow into the radial compressor based on the command signal, and wherein the bypass valve fluidly connects to an outlet line coupled to the radial compressor and to an inlet line coupled to the radial compressor, the bypass valve allowing for recirculation of the gas flow through the radial compressor.

2. An avoidance system for avoiding an impending stall or surge in a radial compressor, comprising:

a detection system comprising a plurality of detection devices coupled to the radial compressor, at least a portion of each detection device disposed in a diffuser channel of a diffuser of the radial compressor, the plurality of detection devices configured to detect a transition of a low momentum zone of a gas flow through the diffuser from a first location of the different locations in the diffuser channel adjacent a shroud wall of the diffuser to a second location of the different locations in the diffuser channel adjacent a hub wall of the diffuser;

a control system electrically coupled to the plurality of detection devices and configured to receive a plurality of information signals, each information signal being transmitted by a respective one of the plurality of detection devices and correlating to a location of the low momentum zone, the control system further being configured to process the plurality of information signals and detect the impending stall or surge based on the location of the low momentum zone; and a bypass valve electrically coupled to the control system and in fluid communication with the radial compressor, wherein the control system is further configured to generate and transmit a command signal to the bypass valve based on the location of the low momentum zone, and the bypass valve is configured to receive the command signal and vary the amount of the gas flow into the radial compressor based on the command signal, and wherein the bypass valve is directly fluidly coupled to an outlet line of the radial compressor, and wherein the bypass valve is further directly fluidly coupled to an inlet line of the radial compressor, the bypass valve, which is directly fluidly connected to the outlet line and is directly fluidly connected to the inlet line of the radial compressor, allowing for recirculation of the gas flow through the radial compressor.

3. The avoidance system of claim 2, wherein at least one detection device of the plurality of detection devices comprises a sensor, the sensor being selected from the group consisting of a static pressure tap, a total pressure probe, a combination probe, a dynamic pressure probe, a 5-hole probe, and a 3-hole probe.

4. The avoidance system of claim 2, wherein the plurality of detection devices comprises:

at least one first detection device coupled to the hub wall of the diffuser and configured to detect the location of the low momentum zone at the second location by measuring a first pressure of the gas flow in the diffuser channel proximate the hub wall; and at least one second detection device coupled to the shroud wall of the diffuser and configured to detect the location of the low momentum zone at the first location by measuring a second pressure of the gas flow in the diffuser channel proximate the shroud wall.

5. A method for avoiding an impending stall or surge in a radial compressor, comprising:

at least partially disposing a plurality of detection devices in a diffuser channel of a diffuser of the radial compressor;

arranging the plurality of detection devices to measure pressure of gas flow at different locations in the diffuser channel;

transmitting an information signal from each of the plurality of detection devices to a control system, the information signal correlating to a first location and a second location of the different locations in the diffuser channel;

processing in the control system the information signal received from each of the plurality of detection devices, such that the control system detects the second location of the different locations in the diffuser channel as being indicative of a low momentum zone proximate a hub wall of the diffuser;

processing in the control system the information signal received from each of the plurality of detection devices, such that the control system detects the first location of the different locations in the diffuser channel as being indicative of a low momentum zone proximate a shroud wall of the diffuser; and detecting in the control system the impending stall or surge based on movement of the low momentum zone from the first location to the second location;

transmitting from the control system a command signal generated by the control system based on the detecting by the control system of the impending stall or surge; and varying a flow rate of the gas flow in the radial compressor by way of a bypass valve in fluid communication with the radial compressor, the varying of the flow rate of the gas flow based on the command signal generated by the control system;

directly fluidly connecting the bypass valve to an outlet line of the radial compressor;

directly fluidly connecting the bypass valve to an inlet line of the radial compressor;

recirculating the gas flow through the radial compressor by way of the bypass valve, which is directly fluidly connected to the outlet line and directly fluidly connected to the inlet line of the radial compressor, wherein at least one first detection device of the plurality of detection devices is disposed in the diffuser channel adjacent the hub wall of the diffuser to detect the second location of the low momentum zone by measuring a first pressure of the gas flow in the diffuser channel proximate mate the hub wall; and at least one second detection device of the plurality of detection devices is disposed in the diffuser channel adjacent the shroud wall of the diffuser to detect the first location of the low momentum zone by measuring a second pressure of the gas flow in the diffuser channel proximate the shroud wall.

* * * * *